US008780154B2

(12) United States Patent
Rimai

(10) Patent No.: US 8,780,154 B2
(45) Date of Patent: Jul. 15, 2014

(54) CONTROLLING GLOSS IN A SOLID INK JET PRINT

(75) Inventor: Donald Saul Rimai, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 79 days.

(21) Appl. No.: 13/589,553

(22) Filed: Aug. 20, 2012

(65) Prior Publication Data

US 2014/0049577 A1 Feb. 20, 2014

(51) Int. Cl.
*B41J 2/315* (2006.01)

(52) U.S. Cl.
USPC ..... 347/212; 347/18; 347/105

(58) Field of Classification Search
USPC ..... 347/18, 88, 98, 99, 105, 5, 9, 212
IPC ..... B41J 2/17593,2/225
See application file for complete search history.

(56) References Cited

U.S. PATENT DOCUMENTS

| | | | | |
|---|---|---|---|---|
| 5,182,571 | A * | 1/1993 | Creagh et al. | 347/105 |
| 8,262,186 | B2 * | 9/2012 | Chappell et al. | 347/18 |
| 2008/0248196 | A1 | 10/2008 | Anderson et al. | |
| 2011/0025791 | A1 | 2/2011 | Law et al. | |
| 2011/0102525 | A1 | 5/2011 | Larson et al. | |

* cited by examiner

*Primary Examiner* — Lam S Nguyen
(74) *Attorney, Agent, or Firm* — Raymond L. Owens

(57) ABSTRACT

A method for reducing variations in gloss in a solid ink jet image, is disclosed. The method includes: jetting marking solid ink jet droplets onto a receiver to form an image; heating the receiver to a temperature so that the marking solid ink melts; spreading the marking solid ink on the receiver; and controlling the temperature of the marking solid ink on the receiver to provide a desired specularly reflective surface of the solid ink so that variations in gloss are reduced.

3 Claims, 2 Drawing Sheets

CONTROLLING GLOSS IN A SOLID INK JET PRINT

CROSS REFERENCE TO RELATED APPLICATIONS

Reference is made to commonly assigned U.S. patent application Ser. No. 13/562,687 filed Jul. 31, 2012, entitled Wrinkle Elimination for Solid Inkjet Web Printer, by Borden Mills, et al., the disclosure of which is incorporated herein.

FIELD OF THE INVENTION

The present invention relates to controlling the gloss in prints formed by solid ink jet image marking materials.

BACKGROUND OF THE INVENTION

One form of digital printing that is analogous to conventional inkjet printing uses solid inkjet printing. Solid ink jet printers deposit or jet marking particles in a molten or liquid state onto a receiver to form an image. The image is then forced through a nip in a spreader formed by a plurality of rollers, at least one of which is heated to a temperature sufficient to melt the solid ink and subject the inked image to a pressure, while molten, to reduce the height of the ink and spread the ink. As the image exits the nip, the adhesive forces between the molten ink and the contacting roller extends the ink, resulting in variable gloss across the image and differential gloss at the edge of high density regions of the image. This is particularly objectionable in mid density regions especially those comprising halftone patterns. As used herein, the term solid ink refers to an ink that is in solid form at room temperature but is liquefied by heat and jetted when in the liquid or melted state. Solid ink jet ink is a phase change material that is either in a solid or liquid phase. In contrast to toner particles, which comprise an amorphous polymeric binder, these inks are crystalline. Amorphous polymers tend to be hard, whereas crystalline polymers are waxy. Amorphous polymers soften at their glass transition temperature. More specifically, the Young's modulus of an amorphous polymer decreases from about 3 GPa to about 3 MPA as the glass transition temperature Tg is traversed. This is not a phase transition, as there is not a plurality of thermodynamic phases. In general, the Tg of an amorphous polymer is fairly broad. Accordingly, the softening of an amorphous polymer occurs over a temperature range typically between 5 and 10° C. The toughness of amorphous polymers makes them highly suitable for printing applications. Nevertheless, because they require spreading, it is very difficult to provide anacceptable gloss that does not have significant variations.

In contrast to amorphous polymers, crystalline polymers melt at a melting temperature Tm. At this temperature, the polymer undergoes a rapid transition from a solid phase to a liquid phase. The phase transition is sharp, making crystalline polymers suitable for applications where sharp softening temperatures, such as solid inkjet applications, are required. However, because of the crystal structure, crystalline polymers are waxy. Solid ink jetted images have significant relief, with the amount of relief varying with the density of the print. This results in a waxy feel to the print. The variations in density give rise to gloss variations with density as well as gloss variations occurring at the edge of a high density area. The prints are also as subject to damage caused by abrasion. Moreover, these prints can also adhere to one another when they are stored together and placed under pressure due to the flow of the ink.

In US Patent Publication No. 20010102525, relief is addressed by subjecting the inkjet image to heat and pressure in a spreader. The spreader includes a spreader roller and a metal pressure roller opposing the spreader roller.

Oliophobic materials tend to be hydrophilic, i.e. they tend to have high surface energies. Low surface energy liquids tend to wet and adhere to high surface energy solids. Many crystalline polymers suitable for use as solid inkjet inks have low surface tensions, i.e. between approximately 25 dynes/cm and 40 dynes/cm. Most oliophobic surfaces have surface energies in excess of 40 ergs/cm2 and therefore should be wet by the molten ink. This can cause offset wherein some of the molten solid ink sticks to the metal pressure roller.

The present system also has limitations on controlling friction. This further limits the choice of suitable coating materials. In addition, subjecting the image to heat and pressure as described in the related art can result in the prints having a high gloss. This can be objectionable in itself. However, it also augments differential gloss.

Gloss control is difficult with solid ink jet inks such as those used in solid ink jetting. Specifically, solid ink jet inks such as those jetted in solid ink jetting devices, first melt the ink. The ink is then jetted, while in liquid form, and cools and resolidifies on the receiver. Melting is a first order phase transition and is characterized by the presence of a latent heat. According to the laws of thermodynamics, the latent heat is proportional to the change in volume that occurs during first order phase transitions. As a result of the sudden change in volume, internal stresses are frozen into the ink.

The ink droplets solidify in a manner that results in the droplets being in physical relief of the receiver. To reduce the relief, the images are subjected to heat and pressure by a series of heated rollers that remelt the ink and spread the images. This results in the surface of the ink having a glossy appearance as well as a loss of resolution and detail caused by the spreading of the ink and the casting of the inked images against the spreader rollers. The gloss is objectionable when its level is different from the underlying gloss of the receiver and visible in unprinted areas. Moreover, differential gloss can occur with image density variations as the gloss of the receiver is averaged with the gloss of the ink. This is especially noticeable at the edges of high and low density portions of a print.

SUMMARY OF THE INVENTION

In accordance with the present invention, there is provided a method for reducing variations in gloss in a solid ink jet image, comprising in sequence:

jetting marking solid ink jet droplets onto a receiver to form an image;

heating the receiver to a temperature so that the marking solid ink melts;

spreading the marking solid ink on the receiver; and controlling the temperature of the marking solid ink on the receiver to provide a desired specularly reflective surface of the solid ink, whereby variations in gloss are reduced.

In another aspect of this invention, there is provided a method for reducing variations in gloss in a solid ink jet image, comprising in sequence:

jetting marking solid ink jet droplets onto a receiver to form an image;

jetting non-marking solid ink jet droplets onto non-marked image portions of the receiver to uniformly cover at least 50% of the non-marked image portion;

heating the receiver to a temperature so that the marking and the non-marking solid inks melt;

spreading both the marking and non-marking solid ink on the receiver; and controlling the temperature of the marking solid ink on the receiver to provide a desired specularly reflective surface of the solid ink so that variations in gloss are reduced.

In this invention, non-marking solid inks are jetted in non-image areas on the receiver. They are then processed with various steps that are used to control the gloss of the print. It is an important feature of this invention, that cooling of the melted marking and non-marking solid ink jet ink is selected to provide a desired specularity so that variations in gloss are reduced.

In yet another advantage of this invention, the gloss of an image made when practicing this invention are stable when subjected to elevated temperatures such as can occur in closed automobiles or shipping containers during hot days and thereby reduce the adhesion problem discussed above.

Another advantage of this invention is that it can reduce differential gloss and relief artifacts in solid ink jet produced prints.

DETAILED DESCRIPTION OF THE INVENTION

Figure 1:
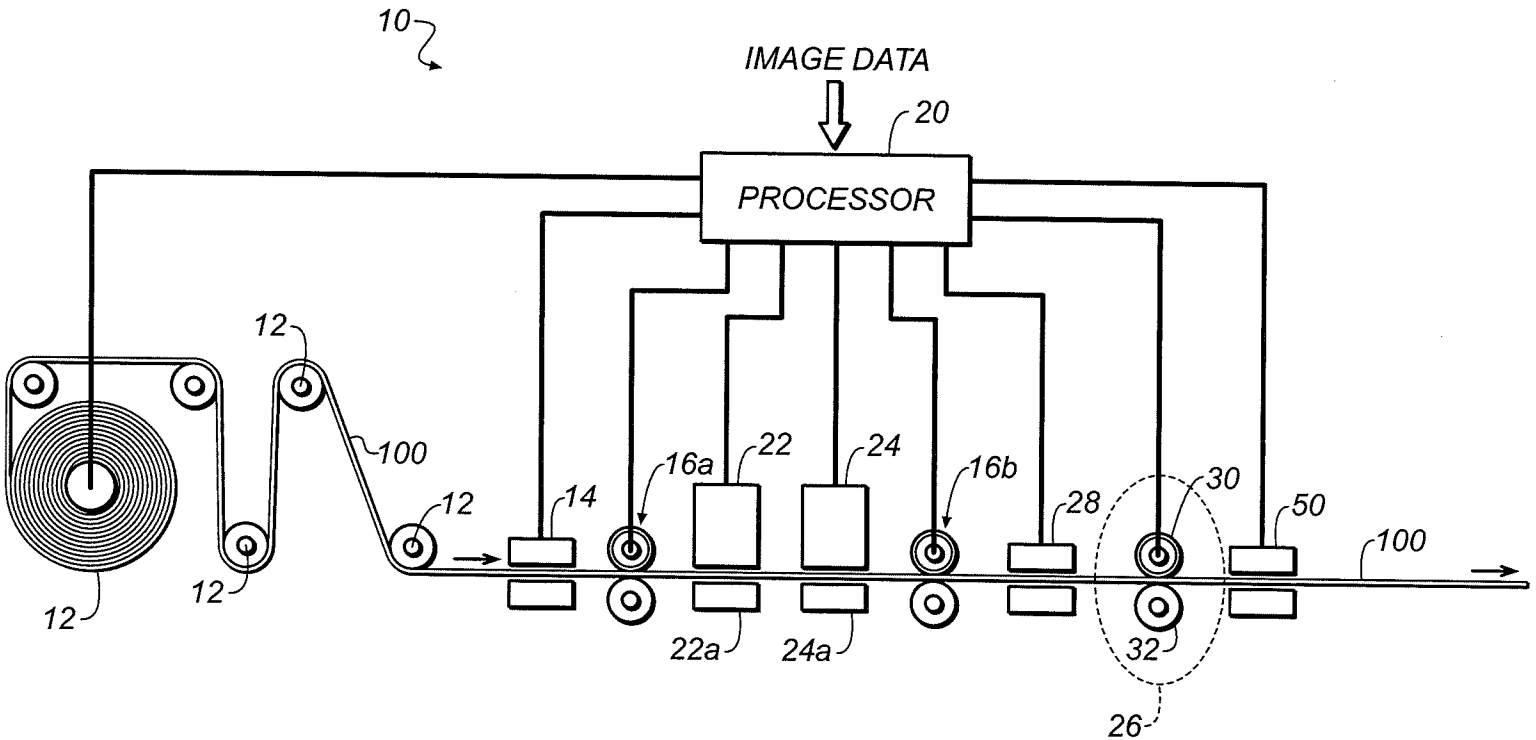
FIG. 1 shows a schematic solid ink printer.

FIG. 1 is a schematic of a solid inkjet printer 10. A roll of material 12 provides a continuous receiver 100. Rollers 12 define the path of the receiver 100. Rollers 12 direct the receiver into a heater 14 that increases the temperature of the receiver 100. Drive rollers 16*a* and 16*b* provide the driving force on the receiver 100 as it advances through the printer 10. A processor 20 controls the operation of the drive rollers 16*a* and 16*b*. The processor 20 controls the operation of print heads 22 and 24. The processor 20 receives image data and controls the operation of the print heads 22 and 24 in response to the image data. The print heads 22, 24 each include a heater under the control of the processor 20 and backing members 22*a* and 24*a* respectively that position the receiver 100 to maintain a gap between them and their print head 22, 24. In response to the image, the processor 20 causes the print heads 22 and 24 to jet solid ink. The print head 24 jets clear non-marking solid ink as will be discussed in more detail later. The print head 22 jets solid marking ink.

A spreader 26 includes a heater 28 and heated and pressure rollers 30, 32 to heat and exert pressure on the solid inkjet ink on the receiver 100 to spread the solid ink jet ink. The receiver 100 then passes through a nip formed by a heated roller 30 and a pressure roller 32 spread the solid ink particles as will be discussed later. The image is the passed through a cooler 50 to form gloss on the image. The cooler 50 can take many forms but basically provides a thermal sink such as a refrigeration unit that provides the appropriate cooling that will be discussed below. The heated roller 30 is oiled and the pressure roller 32 is non-oiled. The non-oiled metal pressure roller 32 can include a coating that is oliophobic and has low adhesion towards the solid ink image but has sufficient lateral friction as to not slide against the ink or the paper web.

For more discussion of the operation of solid inkjet printers and solid inkjet materials, see US Publiciation No. 2011/0025791 entitled, Rollers for Phase-Change Ink Printing, by Law, et al., US Publication 2011/0102525 entitled, Non-Contact Heating of Solid Ink Prints after Ink Fixing, by Larson, et al., and US Publication 2008/0248196 entitled, System and Method for Protecting a Print, by Anderson, et al.

The printer 10 can also jet colored inks corresponding to different colors to make a full color print or to create a print with accent colors. It can also be adapted for duplex printing. It is common to jet making solid ink jet inks corresponding to the subtractive primary colors, i.e. cyan, magenta, yellow, and black. Additional solid marking inks corresponding to specialty colors or having specific properties can also be jetted. The non-marking or clear solid ink jet ink is jetted by print head 24 onto the image in an area of the receiver 100 where there is no marking solid ink jet ink. The areas that have low density making solid ink jet ink so that the receiver 100 can be seen through this ink should have some non-marking ink jetted in the areas of the receiver 100 that lack marking ink jet ink. The amount of non-marking solid ink jet ink jetted can be determined from an electronic file that stores image data and receiver data including the gloss level of the receiver. The amount of non-marking solid ink jet ink jetted also can be determined using a gloss meter that measures the gloss in low or no density regions and mid or high density regions. Alternatively, the amount of non-marking solid ink jet ink can be determined by the operator or customer upon visual inspection of the print. Deposition of the non-marking and marking solid ink jet inks can be done in any desired order.

An image containing regions of variable gloss and differential gloss is then made by pressing the image against a heated roller so that the solid ink jet ink re-melts. The solid inkjet print is delivered from the spreader 26 to the cooler 50 that cools the melted marking and non-marking inkjet ink at a rate selected to provide a desired specularly reflective surface of the solid ink so that variations in gloss are reduced.

Alternatively, if the deposited marking and non-marking solid inkjet ink has already returned to the solid phase, it is desirable to reheat them. In one method of practicing this invention, the solid inkjet ink is reheated to a temperature sufficient to remelt the solid inkjet ink and the cooler 50 controls the rate of cooling of the solid inkjet ink so that the desired gloss is achieved. The solid inkjet ink can be heated by noncontact heating so that degradation of the print is reduced. Alternatively, the solid inkjet ink can be heated through the receiver 100 from the non-image side of the receiver 100.

In another alternative, gloss control is achieved by heating the solid non-marking and marking inks to a temperature that is less than the melting temperature of the marking and non-marking solid inks but greater than 10° C. less than the melting temperature of the marking and non-marking solid inks and maintaining that temperature until the gloss is reduced to a desired level. This can be done without using the cooler 50 and is preferably done using noncontact heating of the solid inkjet ink.

In the present invention, a layer of non-marking solid ink is jetted onto portions of the receiver bearing either no or low to mid density ink patterns. After jetting, but before spreading, the non-marking dry ink uniformly covers at least 50% of the unprinted receiver 100. The term "unprinted" refers to regions of the paper that do not bear solid marking ink. Such areas include unprinted portions of the receiver 100 in the vicinity of printed portions of the receiver 100 as well as the spaces between halftone dots within a low to mid density portion of the print. After spreading, the image is subjected to heat the solid ink, such heat not coming from direct contact of the heater to the ink on the receiver 100. To increase gloss, the ink is heated to a temperature in excess of the melting temperature, maintained at that temperature for a time sufficient to permit the ink to flow, and then rapidly cooled to lock in the smooth surface of the ink to create specular reflection. To reduce gloss, the image is heated to a temperature less than the melting temperature of the solid ink but to within 10° C. of the melting temperature and held at that temperature until the desired gloss level is achieved. This process of heating and cooling is similar to annealing to reduce internal stresses in materials and will be referred to as annealing in this specification. Annealing can be done after glossing to reduce the gloss level. Alternatively, annealing can be accomplished without glossing by heating the image after spreading. This makes the gloss pattern on the image more uniform.

The solid ink jet inks used when practicing this invention should have melting temperatures within 10° C. of each other. However, the non-marking solid ink jet inks can have a substantially different latent heat of fusion, whereby a smaller latent heat of fusion would permit the image to retain a relatively high gloss, whereas a larger latent heat of fusion would permit more deglossing of the image. Thus, when printing on a glossy receiver 100 such as a glossy clay coated paper commonly used in graphic arts, it can be desirable to choose a non-marking solid ink jet ink with a small latent heat of fusion for example polyethylene or polypropylene (latent heat of fusion less than 10,000 J/mol).

Differential gloss is an artifact that is commonly observed in images having a noticeable height difference between low and high density regions of glossy prints. This arises from light reflected off the edge of the glossy high density portion of the image whereas the lower density portions of the image do not exhibit a corresponding high density. Differential gloss appearance is further augmented by the height difference in the image, giving rise to an artifact known as relief. Both relief and differential gloss complement each other and can be similar in appearance.

Inverse masking is often used in electrophotography to control gloss, provide protection from UV radiation and abrasion, and to permit control of toner stack heights. In those applications, the quantity of non-marking or clear toner deposited is in direct inverse proportion to the amount of marking toner deposited so as to level the toner stack heights. As toner does not melt and experiences limited flow during fusing, such leveling is necessary. In the present invention, the amount of non-marking solid ink jetted by print head 24 onto the receiver 100 does not need to be in direct inverse proportion to the amount of marking solid ink. Moreover, jetting quantities of solid ink that would totally level the heights of the high density ink depositions would be more than would be desired and would result in a brittle, waxy looking print. Rather, it is desirable to inversely deposit non-marking or clear solid ink just to the level between where half and all the unprinted portions of the receiver 100 are coated. Upon spreading and annealing, the receiver 100 can be sufficiently coated to provide constant gloss levels irrespective of image density. In such as printer solid ink jet ink is heated to a temperature sufficient to melt the solid ink and transform the solid ink into a liquid that is jetted onto a receiver 100. After jetting the solid ink rapidly cools to a temperature below its melting temperature and solidifies. This creates elevated regions of ink on the receiver 100, the amount of elevation depending on the amount of ink jetted and thereby the density of the image in a region of the receiver 100. To reduce the variations in elevation, the ink is subjected to a process known as spreading using the spreader 26.

Figure 2:
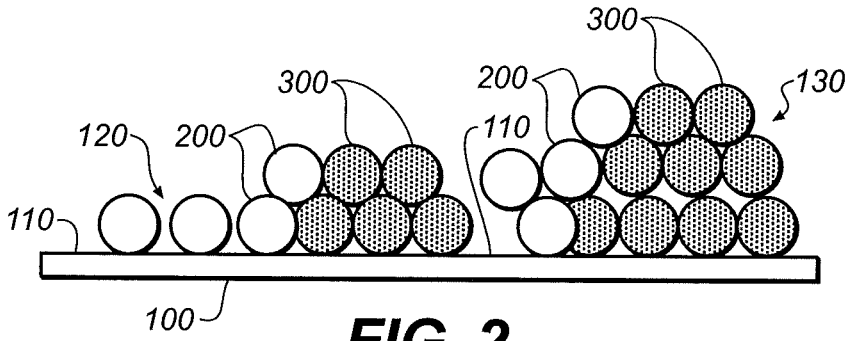
FIG. 2 shows a solid ink image having unprinted, low to medium density printed regions, and high density regions of the marking solid ink and cleat non-marking solid ink particles before spreading.
Figure 3:
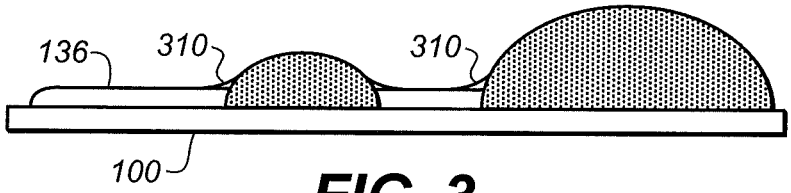
FIG. 3 shows the image in FIG. 2 after spreading.

FIG. 2 shows an image produced by the ink jet printer 10 prior to spreading. The image has marking solid ink droplets 300 and non-marking solid ink droplets 200. After jetting, the solid ink has rapidly cooled below its melting temperature to produce these markingsolid ink droplets 300.) There are elevated regions of marking solid ink droplets 300. In the spreader 26, the receiver 100 passes through the nip formed by the heated roller 30 and the pressure roller 32 to heat the marking solid ink droplets 300 to a temperature in excess of the melting temperature of the solid ink in the lower density 120 regions, as occur in low density 120 and mid density regions of the image and the high density 130 regions of the print, as illustrated in FIG. 3. While spreading reduces the height variations in the ink, it does not limit such variations. The spread of non marking solid ink, however, does cover a larger area of the receiver 100, thereby reducing resolution.

When printing using solid ink jet technology, a semi-crystalline or waxy ink is heated to a temperature in excess of the melting temperature of the solid ink and marking solid ink droplets 300 are jetted onto the receiver 100 using known methods such as by producing a pressure wave in a jetting nozzle by applying a stress to a piezoelectric jetting head. The semi-crystalline ink contains colorant such as a dye or pigment in a semi-crystalline matrix. High density 130 regions of the image are produced by jetting more droplets into a given area of the receiver 100. Lower density 120 regions are created by jetting fewer marking solid ink particles droplets 300 onto the receiver 100. Very low density 120 regions contain few or no droplets. The resulting image has contains ink regions of varying thickness ranging from very thick and objectionable to little or no ink. The heat and pressure applied to the ink reduces the height of the inked region, spreading the ink, thereby reducing resolution, and produces a smooth surface 136 that specularly reflects light from spread ink.

The presence of low or uninked portions 110 of the receiver 100 adjacent to the inked regions also permits specularly reflected light from the side of the surface 136 of the spread ink to provide the appearance of differential gloss.

FIG. 3 shows an embodiment of the present invention wherein non-marking solid ink droplets 200 are jetted into the regions between portions of the image containing solid ink. The amount of non-marking solid ink jetted should be sufficient to allow a uniform coating of non-marking solid ink coating on at least half of the receiver that does not contain colored or marking solid ink. Alternatively, it may be advantageous to coat up to 100% of the receiver 100 that does not get coated with marking solid ink. After spreading, the spread solid ink coats the receiver 100, thereby making the gloss level appear more uniform across the entire print.

In FIG. 2, non-marking solid ink droplets 200 are jetted so that the amount of non-marking solid ink increases monotonically as with decreasing separation distance from the mass of marking solid ink. This method of practicing the invention blends the reflection of light emanating from a higher density 130 region and reduces differential gloss. FIG. 3 shows the incremental clear solid ink 310 around higher density 130 regions after spreading.

For purposes of this invention, for prints containing a plurality of colored solid inks, it is preferred that the ink be heated to a temperature that is sufficient to melt the solid ink with the highest melting temperature. However, some glossing can be obtained as long as at least some of the solid inks are heated to a temperature in excess of their melting temperature. To de-gloss a print, the annealing temperature should not exceed the melting temperature of the solid ink with the lowest melting temperature.

Figure 4:
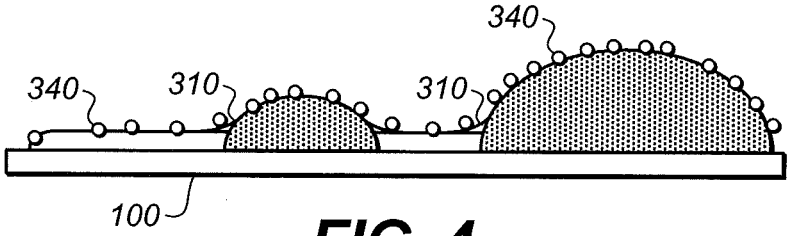
FIG. 4 shows the image of FIG. 3 after noncontact heating the solid ink jet ink to a temperature that is at least 10° less than the melting temperature and maintaining that temperature until the gloss is reduced to a desired level.

FIG. 4 shows undulations 340 induced on the surface of both the non-marking and marking solid ink areas after the solid ink had been subjected to the annealing process. Although showed in one color, it is clear that the undulations 340 would be essentially the same color as the solid ink. Such undulations 340 scatter light and reduce specular reflection and thus reduce glare. It is also apparent that the undulations 340 on the transition portions of the solid incremental clear ink 310 between low density 120 and high density 130 portions of the image reduce differential gloss.

The invention has been described in detail with particular reference to certain preferred embodiments thereof, but it will be understood that variations and modifications can be effected within the spirit and scope of the invention

PARTS LIST

10 printer
12 roll of material
14 heater
16*a* driver rollers
16*b* driver rollers
18 rollers
20 processor
22 print head
22*a* backing members
24 print head
24*a* backing members
26 spreader
28 heater
30 heated roller
32 pressure roller
50 cooler
100 rceiver
110 uninked portions
120 low density
130 high density
136 smooth surface
200 non marking solid ink droplets
300 marking solid ink droplets
310 incremental clear solid ink
340 undulations

The invention claimed is:

1. A method for reducing variations in gloss in a solid ink jet image, comprising in sequence:

a. jetting marking solid ink jet droplets onto a receiver to form an image;

b. jetting non-marking solid ink jet droplets onto non-marked image portions of the receiver to cover at least 50% of the non-marked image portion, wherein more non-marking solid ink is jetted adjacent to the edge of the jetted marking solid ink and less non-marking solid ink is jetted further away from the edge of the jetted marking solid ink;

c. heating the receiver to a temperature so that the marking and the non-marking solid inks melt;

d. spreading both the marking and non-marking solid ink on the receiver; and e. controlling the temperature of the marking solid ink on the receiver to provide a desired specularly reflective surface of the solid ink so that variations in gloss are reduced.

2. The method according to claim 1, wherein element e includes cooling the melted marking and non-marking solid inks at a rate selected to provide a desired specularly reflective surface of the solid ink so that variations in gloss are reduced.

3. The method according to claim 1, wherein element e includes using noncontact heating to heat the solid non-marking and marking inks to a temperature that is less than the melting temperature of the marking and non-marking solid inks but greater than 10° C. less than the melting temperature of the marking and non-marking solid inks and maintaining that temperature until the gloss is reduced to a desired level.

* * * * *